United States Patent [19]

Stroem

[11] Patent Number: 4,624,104

[45] Date of Patent: Nov. 25, 1986

[54] VARIABLE FLOW GAS TURBINE ENGINE

[75] Inventor: Sigmunn Stroem, Kongsberg, Norway

[73] Assignee: A/S Kongsberg Vapenfabrikk, Kongsberg, Norway

[21] Appl. No.: 610,507

[22] Filed: May 15, 1984

[51] Int. Cl.[4] ..... F02C 7/00

[52] U.S. Cl. ..... 60/39.75; 415/115; 415/DIG. 1

[58] Field of Search ..... 415/DIG. 1, 115, 116; 60/39.02, 39.75

[56] References Cited

U.S. PATENT DOCUMENTS

| | | | |
|---|---|---|---|
| 2,825,532 | 3/1958 | Kadosch et al. | 415/115 |
| 3,039,736 | 6/1962 | Pon | 415/DIG. 1 |
| 3,306,576 | 2/1967 | Chaboseau | 415/115 |
| 3,643,675 | 2/1972 | Wetterstad . | |
| 4,228,753 | 10/1980 | Davis et al. . | |

FOREIGN PATENT DOCUMENTS

| | | | |
|---|---|---|---|
| 659211 | 8/1936 | Fed. Rep. of Germany | 415/DIG. 1 |
| 963540 | 7/1950 | France | 415/DIG. 1 |
| 1030483 | 6/1953 | France . | |
| 1456926 | 10/1966 | France . | |
| 2284040 | 4/1976 | France . | |
| 642720 | 4/1984 | Switzerland . | |
| 730573 | 5/1955 | United Kingdom . | |
| 767513 | 2/1957 | United Kingdom . | |
| 2099929 | 12/1982 | United Kingdom . | |

OTHER PUBLICATIONS

One page extract from proprietary Kongsberg document entitled"Preliminary Dura Engine Data", dated Dec. 9, 1982.

*Primary Examiner*—Louis J. Casaregola

*Attorney, Agent, or Firm*—Finnegan, Henderson, Farabow, Garrett & Dunner

[57] ABSTRACT

A variable flow gas turbine engine of the type having a combustor for generating combustion gases and a turbine rotor for receiving and expanding the hot combustion gases, has an outer wall and an end wall defining a channel for directing the flow of combustion gases from the combustor to the rotor; a plurality of fixed guide vanes mounted in the channel, the space between adjacent vanes forming at least one throat; a winglet fixedly mounted in the throat for separating the gases flowing through the throat into first and second streams; and a passage through at least one of the vanes into the throat, the passage being in fluid communication with source of air under pressure for injecting high pressure into the throat for varying the flow of combustion gases through the second stream. A method for varying the effective flow area of combustion gases in a gas turbine engine is also disclosed.

8 Claims, 3 Drawing Figures

VARIABLE FLOW GAS TURBINE ENGINE

FIELD OF THE INVENTION

This invention relates to gas turbine engines, particularly those of the radial in-flow type. More particularly, the invention relates to gas turbine engines in which the effective flow area for the combustion gases through the turbine can be varied under different operating conditions.

BACKGROUND OF THE INVENTION

Flow operated machinery, such as gas turbines, are typically designed for a particular operational condition which will be most frequently encountered in the environment where that particular machine will be utilized. In that situation, operation of the machine under the design condition will produce optimum proficiency. As a practical matter, however, it is often necessary to operate such machines under conditions which vary substantially from the optimum design parameters. This particularly occurs during part load operation of a turbine, where gas throughputs are considerably less than those encountered under optimum operating conditions. This obviously causes a reduction in the efficiency of the turbine and instabilities in the operation of the machine.

Several attempts have been made in the prior art to control the effective flow area of gases flowing to the turbine rotors of a gas turbine engine. In one such structure, rotation of the vanes was utilized to change the flow area, but this also changes the flow angle of the air flow impinging on the turbine rotors. Another prior art approach involves the use of an end wall which was movable in the axial direction to achieve a reduction in the cross-sectional flow area. Both of these prior art attempts to achieve flow area changes require the use of fairly elaborate mechanical apparatus which has presented sealing and cooling problems, and which detracts from any gain in efficiency achieved by the variable flow area feature.

A technique for varying the flow pattern in a turbine machine is disclosed in U.S. Pat. No. 3,643,675 to Wetterstad. The Wetterstad patent describes an apparatus for controlling the velocity profile of a working medium in a turbine, including a plurality of conduits radially disposed in an inlet of the turbine for introducing or injecting a control medium tangentially into the working fluid of the turbine. The control fluid imparts a rotational motion to the working fluid. The flow path of the working fluid also includes a restriction for reducing the cross-sectional area of the flow path of the working fluid to amplify the rotational motion of the fluid. This prior approach was specifically intended to eliminate the use of guide vanes which are considered by Wetterstad to be complicated and expensive, and which are said to give rise to flow losses.

Although this prior art approach does allow for variation of the velocity profile of the turbine gases, it has not proven to be effective in practice, and has not been adopted commercially.

Accordingly, it is a primary object of this invention to improve the operational efficiency of a gas turbine engine.

It is a further object of this invention to vary the effective flow area of gases flowing from the combustors of gas turbine engine to the turbine rotors thereof.

Yet another object of the invention is to efficiently operate a gas turbine engine under varying loads and flow regimes.

Additional objects and advantages will be set forth in part in the description which follows, and in part, will be obvious from the description, or may be learned by practice of the invention.

SUMMARY OF THE INVENTION

To achieve the foregoing objects and in accordance with the purpose of the invention, as embodied and broadly described herein, the variable flow gas turbine engine of the present invention includes a combustor for generating combustion gases and a turbine rotor for receiving and expanding the hot combustion gases. The invention comprises duct means defining a channel for directing the flow of combustion gases from the combustor to the rotor; vane means in the channel forming at least one throat; and means for varying the effective flow area of combustion gases impinging on the rotor from the throat, the varying means including winglet means fixedly mounted in the throat for separating the gases flowing through the throat into first and second streams; and means for injecting high pressure fluid into the throat for varying the flow of combustion gases in one of the streams. The winglet means is typically an aerodynamically shaped winglet.

Preferably, the vane means includes a plurality of fixed guide vanes mounted in the channel, the space between adjacent vanes forming the throat. It is also preferred that the vanes be aerodynamically shaped.

The injecting means preferably includes a passage through each vane into the throat, the passage being in fluid communication with a source of air under pressure. It is also preferred that the injecting means include means for controlling the flow of the air under pressure through the passage. The passage may include a plurality of holes exiting into the throat.

The duct means typically includes an outer wall and an end wall, with the vanes being mounted between the walls. The winglet may include inner and outer sides, the first stream passing over the outer side and the second stream passing over the inner side. Preferably, the winglet is attached to the outer and end walls between a pair of the adjacent vanes. Each vane may include an enlarged upstream portion and a tapered downstream portion, the passage passing through the vane substantially between these portions.

The invention also includes a method for varying the effective flow area of combustion gases in a gas turbine engine comprising the steps of passing the combustion gases through a confined area; separating the gas flowing through the confined area into at least first and second streams of gas; injecting fluid under pressure into one of the first and second streams for varying therefore the flow of combustion gases in one of the stream; and channeling the remaining gas stream directly onto a turbine rotor. Preferably, the step of separating includes the step of passing the gases over an aerodynamically shaped winglet, and the step of injection preferably includes the step of directing high pressure air onto one side of the winglet.

BRIEF DESCRIPTION OF THE DRAWING

The accompanying drawings which are incorporated in and constitute a part of this specification, illustrate one embodiment of the invention and, together with a description, serve to explain the principals of the invention.

DESCRIPTION OF THE PREFERRED EMBODIMENT

Figure 1:
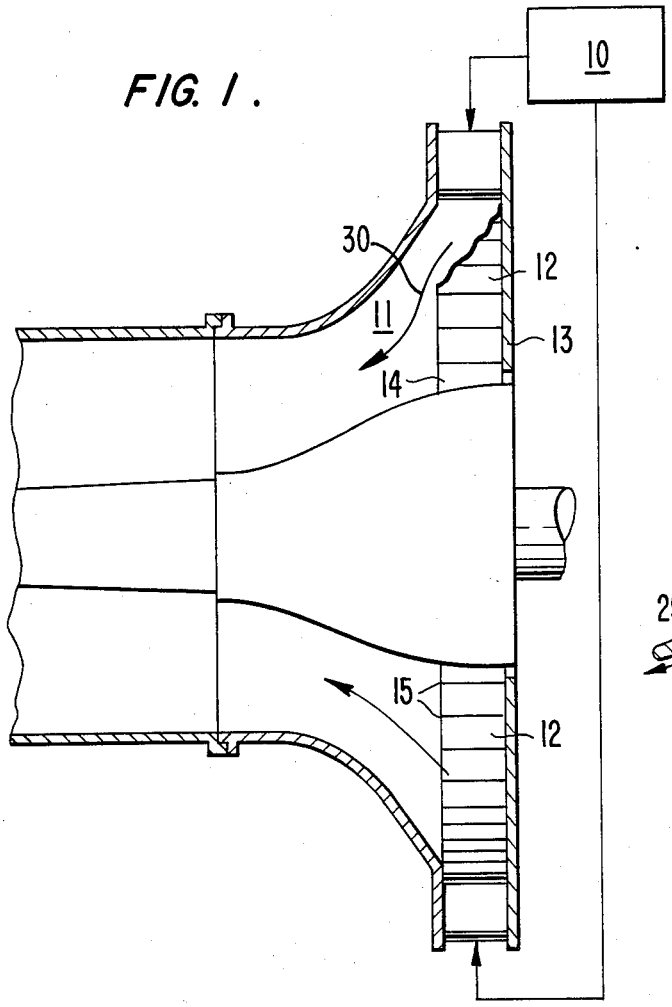
FIG. 1 is a schematic cross-sectional view of the gas turbine engine of the present invention.
Figure 2:
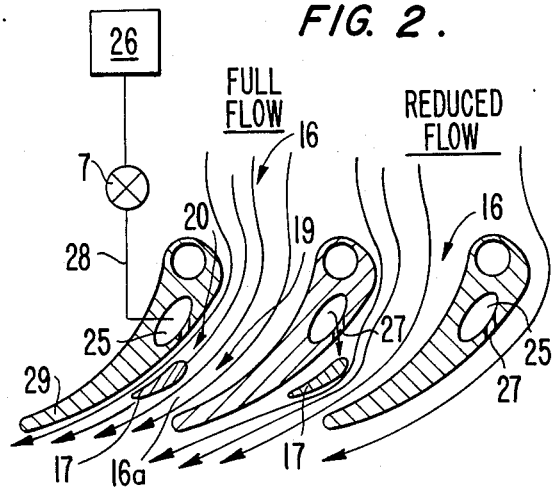
FIG. 2 is an enlarged cross-sectional view showing the vanes, the winglets, and the variable flow patterns.
Figure 3:
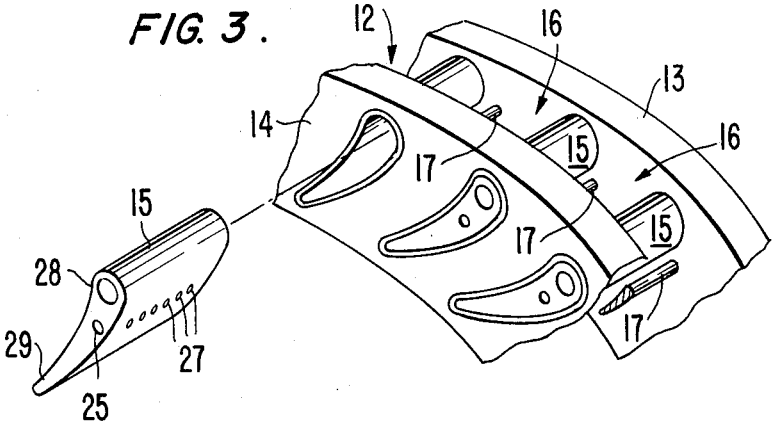
FIG. 3 is a partial perspective view of the duct portion of the invention.

Reference will now be made in detail to the present preferred embodiment of the invention, an example of which is illustrated in the accompanying drawings.

In accordance with the invention, the variable flow gas turbine engine of the present invention is of the type having a combustor for generating combustion gases and a turbine rotor for receiving and expanding the hot combustion gases. The invention comprises duct means defining a channel for directing the flow of combustion gases from the combustor to the rotor; vane means in the channel forming at least one throat; and means for varying the effective flow area of combustion gases impinging on the rotor from the throat, the varying means including winglet means fixedly mounted in the throat for separating the gases flowing through the throat into first and second streams; and means for injecting high pressure fluid into the throat for varying the flow of combustion gases in one of the streams.

As embodied herein, and as shown in the drawing, a typical gas turbine engine includes a combustor 10 where fuel is mixed with air and ignited to form combustion gases. These gases are then channeled through the turbine to impinge upon the blades (not shown) of a turbine rotor 11 causing the turbine to rotate as the gases expand. In the illustrated embodiment, the duct means comprises a confined flow channel 12, including an outer wall 13 and an end wall 14. The walls 13 and 14 define the channel 12 for directing the flow of combustion gases from the combustor 10 to the rotor 11 as shown by the arrows 30.

As embodied herein, the vane means includes a plurality of fixed guide vanes 15 mounted in the channel 12 and shown partially cut-away in FIG. 1. The space between adjacent vanes 15 forms a passage 16 which includes throat 16*a*. The combustion gases from the combustor 10 pass over the fixed guide vanes 15 and through the throats 16*a* formed by the guide vanes 15. The turbine rotor receives the hot gases exiting from the throats 16*a*.

In the illustrated embodiment, the winglet means includes an aerodynamically shaped winglet 17 fixedly mounted in the throat 16*a* for separating the gases flowing through the passage into first and second streams 19 and 20.

As embodied herein, the injecting means includes a passage 25 through the vane 15 into the passage 16 upstream of throat 16*a*. The passage 25 is in fluid communication with a source of air under pressure 16. Control means 7 may be provided for controlling the flow of the air under pressure through the passage 25 to occur during operating conditions requiring a reduced effective throat area, such as during part load operation. The control means may include appropriate valves and suitable mechanical or electrical structure for controlling the valves, known to those skilled in the art. The passage 25 may include a plurality of holes 27 exiting into the passage 16.

As illustrated, the vane 15 includes an enlarged upstream portion 28 and a tapered downstream portion 29. The passage 25 passes through the vane 15. The winglet 17 may be attached to the opposing surfaces of the outer and end walls 13 and 14 by a suitable means, such as welding. The winglet 17 may also extend over only a portion of the distance between the walls 13 and 14, and may be attached to either wall 13 or 14 in that configuration. The winglet may be formed of any suitable material, including various metals used in turbine applications, as well as ceramic materials. The vanes 15 may also include additional openings therein for cooling the vanes during operation of the turbine.

In operation, combustion gases from the combustor 10 pass through the channel 12 formed by the walls 13 and 14. The gases flow between adjacent guide vanes 15, and under normal operating conditions requiring full throat area separate into first and second streams 19 and 20 as they reach the leading edge of winglet 17. Under normal conditions, with no injection of high pressure air through the passage 25, the gases from both streams 19 and 20 impinge directly on the blades of the turbine rotor 11. This condition will typically be utilized for gas turbine engine performance regimes requiring maximum throat or combustion gas flow area.

The shape of the surface of the vane 15 is designed in accordance with the flow velocities expected during normal engine operation so as to prevent the streamlines of the combustion gases passing close to the vane 15 from separating from the projection face. Based on the disclosure herein, one skilled in the art can readily determine the precise shape needed for a given engine design condition.

For flow regimes where a smaller cross sectional flow area is required in the throat for optimum turbine efficiency, high pressure air or gas is fed through the passage 25 causing the second stream 20 to effectively "close off". In other words, combustion gases ordinarily flowing into second stream 20 are deflected into first stream 19, and as the amount of high pressure air directed through the passage 25 is increased, the flow streamlines of the combustion gases passing through the passage 16 to lift off the surface of the vane 15 and to contact the opposite side of the winglet 17. A smaller cross-sectional area of combustion gases then impinge upon the turbine rotor 11.

The precise aerodynamic design of the winglet 17 can also be accomplished by one skilled in the art based on the disclosure herein in order to provide optimum flow conditions for a given gas turbine flow regime. The precise arrangement of the vane 15 and the winglet 17 for best overall operation will depend upon numerous design factors known to those skilled in the art.

In addition to the gas turbine engine described above, the invention also includes a method for varying the effective flow area of combustion gases in a gas turbine engine. The method of the invention comprises the steps of passing the combustion gases through a confined area; separating the gas flowing through the confined area into at least first and second streams of gas; injecting fluid under pressure into one of the first and second streams for closing off the flow of combustion gases in one of the streams; and channeling the remaining gas stream directly onto a turbine rotor. The step of separating may include the step of passing the gases over an aerodynamically shaped winglet, and the step of injecting may also include the step of directing high pressure air onto one side of the winglet. The method of this invention may be carried out by utilizing the structure disclosed herein, or any other suitable structure.

As will be evident from the above, the present invention provides substantial advantages over the prior art. It will be apparent to those skilled in the art that various modifications and variations could be made in the structure of the invention without departing from the scope or spirit of the invention.

What is claimed is:

1. A variable flow gas turbine engine of the type having a combustor for generating combustion gases and a turbine rotor for receiving and expanding the hot combustion gases, comprising:

duct means for defining a channel for directing the flow of combustion gases from said combustor to said rotor;

vane means in said channel forming at least one throat;

means for varying the effective flow area for combustion gases flowing through said throat and impinging on said rotor, said varying means including winglet means fixedly mounted in said throat for separating the gases flowing through said throat into first and second streams; and means for injecting high pressure fluid into said throat for varying the flow of combustion gases in one of said streams.

2. The variable flow gas turbine engine of claim 1 wherein said vane means includes a plurality of fixed guide vanes mounted in said channel, the space between adjacent vanes forming said at least one throat.

3. The variable flow gas turbine engine of claim 2 wherein said winglet means includes an aerodynamically shaped winglet.

4. The variable flow gas turbine engine of claim 3 wherein said injecting means includes a passage through a vane into said throat, said passage being in fluid communication with a source of air under pressure; and means for controlling the flow of said air under pressure through said passage.

5. The gas turbine engine of claim 4 wherein said duct means includes an outer wall and an end wall, said winglet being attached to at least one of said walls, and extending at least partially between said walls.

6. The gas turbine engine of claim 5 wherein a vane includes an enlarged upstream portion and tapered downstream portion, and said passage includes a plurality of holes passing through said vane.

7. The gas turbine engine of claim 6 wherein said winglet is attached to the opposing surfaces of said walls, and extends across the full space between said walls.

8. The gas turbine engine of claim 7 wherein said winglet includes inner and outer sides, said first stream passing over said outer side and said second stream passing over said inner side, said winglet oriented to be substantially parallel to, and spaced between an adjacent pair of said vanes.

* * * * *